US010442607B2

(12) United States Patent
Rudolf

(10) Patent No.: US 10,442,607 B2
(45) Date of Patent: Oct. 15, 2019

(54) CREASED BLANK FOR FORMING A CONTAINER WITH ROUND OR BEVELED CORNERS

(71) Applicant: PHILIP MORRIS PRODUCTS S.A., Neuchatel (CH)

(72) Inventor: David Rudolf, Kutna Hora (CZ)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/740,471

(22) PCT Filed: Jul. 29, 2016

(86) PCT No.: PCT/EP2016/068255
§ 371 (c)(1),
(2) Date: Dec. 28, 2017

(87) PCT Pub. No.: WO2017/021343
PCT Pub. Date: Feb. 9, 2017

(65) Prior Publication Data

US 2018/0194542 A1 Jul. 12, 2018

(30) Foreign Application Priority Data

Jul. 31, 2015 (EP) ..... 15179419

(51) Int. Cl.
*B65D 85/10* (2006.01)
*B65D 5/42* (2006.01)

(52) U.S. Cl.
CPC ..... *B65D 85/1045* (2013.01); *B65D 5/4266* (2013.01)

(58) Field of Classification Search
CPC ..... B65D 5/4266; B65D 85/1045
(Continued)

(56) References Cited

U.S. PATENT DOCUMENTS 4,955,531 A 9/1990 Graboyes
5,435,440 A * 7/1995 Focke ..... B65D 5/6691 206/265

(Continued)

FOREIGN PATENT DOCUMENTS

CN 1291899 12/2006
CN 101022998 8/2007

(Continued)

OTHER PUBLICATIONS

European Extended Search Report for Application No. 15179419.5-1708 dated Dec. 8, 2015 (11 pages).

(Continued)

*Primary Examiner* — Luan K Bui
(74) *Attorney, Agent, or Firm* — Mueting, Raasch & Gebhardt, P.A.

(57) ABSTRACT

A blank (300) for forming a container for consumer articles comprises panels (308, 309, 312, 314) for forming corresponding walls of the container. First side panels (311) extend from the rear wall panel (312) and second side panels (310) extend from the front wall panel (308). When assembling the container, the first and the second side panels overlap to form at least part of left and right side walls. The first side panels or the second side panels or both are connected to the respective one of the rear wall panel and the front wall panel by modified edge portions (3100, 3110, 3120, 3130). The blank comprises a pair of flaps extending from the first side panels or the second side panels or both.

14 Claims, 4 Drawing Sheets

(58) Field of Classification Search
USPC ..... 206/261, 265, 268, 271, 273
See application file for complete search history.

(56) References Cited

U.S. PATENT DOCUMENTS

| | | | | |
|---|---|---|---|---|
| 5,478,011 | A * | 12/1995 | Pham | B65D 85/1045 229/148 |
| 6,004,251 | A | 12/1999 | Herrin | |
| 6,276,600 | B1 * | 8/2001 | Rigby | B65D 85/1045 206/273 |
| 6,302,322 | B1 * | 10/2001 | Focke | B65D 85/1045 206/268 |
| 6,311,834 | B1 * | 11/2001 | Focke | B65D 5/6691 206/268 |
| 6,457,580 | B1 * | 10/2002 | Focke | B65D 85/1045 206/259 |
| 7,455,176 | B2 | 11/2008 | Focke | |
| 7,506,755 | B2 | 3/2009 | Buse | |
| 2003/0106928 | A1 | 6/2003 | Li | |
| 2004/0144661 | A1 * | 7/2004 | Lutzig | B65D 5/6691 206/268 |
| 2005/0082178 | A1 * | 4/2005 | Draghetti | B65D 85/1045 206/242 |
| 2006/0006078 | A1 * | 1/2006 | Vaccari | B65D 5/4279 206/273 |
| 2007/0284267 | A1 | 12/2007 | Buse | |
| 2010/0044256 | A1 * | 2/2010 | Tanbo | B65D 5/4266 206/268 |
| 2013/0206617 | A1 * | 8/2013 | Lutzig | B65D 5/18 206/268 |

FOREIGN PATENT DOCUMENTS

| | | |
|---|---|---|
| DE | 102004045279 | 3/2006 |
| DE | 102008061661 | 6/2010 |
| DE | 102011109363 | 2/2013 |
| DE | 10201219557 | 4/2014 |
| EP | 2022729 | 2/2009 |
| EP | 2141090 | 1/2010 |
| EP | 2277804 | 1/2011 |
| EP | 2689923 | 1/2014 |
| EP | 2690033 | 1/2014 |
| EP | 2700583 | 2/2014 |
| GB | 2358176 | 7/2001 |
| WO | WO 03/053817 | 7/2003 |
| WO | WO 03/093136 | 11/2003 |
| WO | WO 2011/151175 | 12/2011 |
| WO | WO 2012/123189 | 9/2012 |
| WO | WO 2016/107900 | 7/2016 |
| WO | WO 2016/107929 | 7/2016 |

OTHER PUBLICATIONS

PCT/EP2016/068255 International Search Report and Written Opinion dated Sep. 12, 2016 (12 pages).
Office Action issued in China for Application No. 201680038555.2 dated Feb. 2, 2019 (English translation included).

* cited by examiner

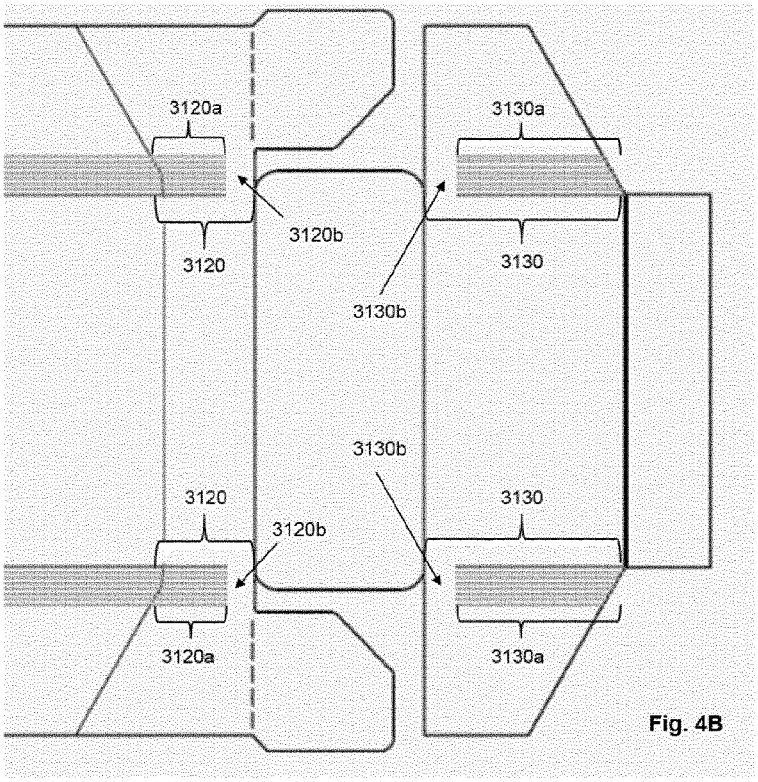
Fig. 4B
Fig. 5
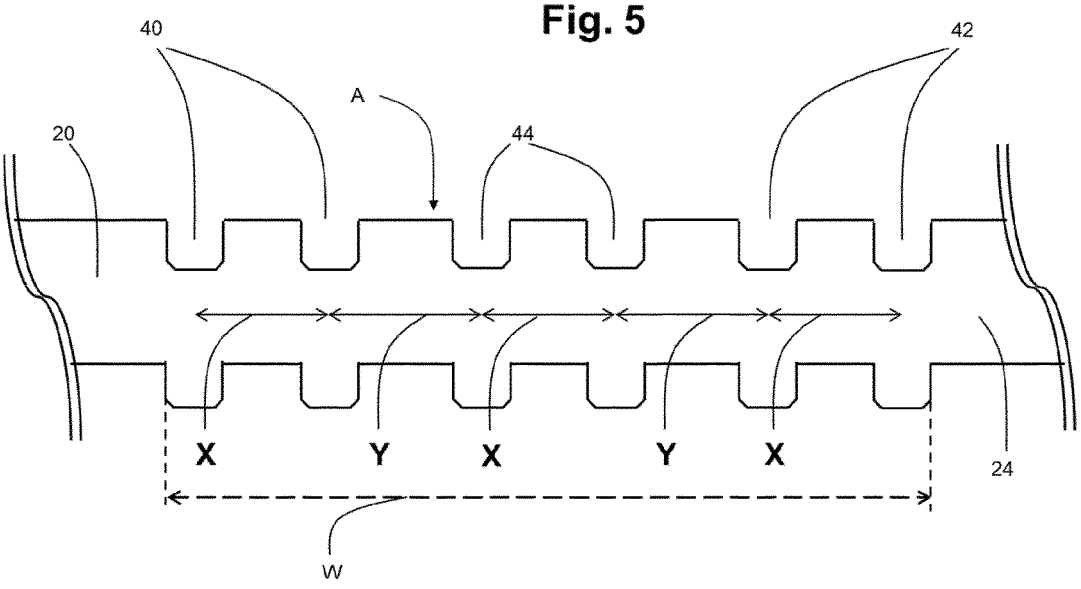

CREASED BLANK FOR FORMING A CONTAINER WITH ROUND OR BEVELED CORNERS

This application is a U.S. National Stage Application of International Application No. PCT/EP2016/068255, filed Jul. 29, 2016, which was published in English on Feb. 9, 2017, as International Publication No. WO 2017/021343 A1. International Application No. PCT/EP2016/068255 claims priority to European Application No. 15179419.5, filed Jul. 31, 2015.

The present invention relates to a blank for forming containers for consumer goods, which find particular application for holding elongate consumer goods, such as smoking articles (for example cigarettes). In more detail, the invention relates to a blank and method for forming parallelepiped-shaped containers having non-square corners, such as round or bevelled corners.

Smoking articles such as cigarettes and cigars are usually provided in soft-pack packs or hard-pack packs, such as flip-top boxes or hinge-lid boxes. These typically have a box part having a box front wall, a box rear wall, box side walls and a box base. They also usually have a lid part with a lid front wall, a lid rear wall, lid side walls and a lid top side. The lid part is typically hinged to the box part along a hinge line extending across a back wall of the container. For hard-pack packs, it is known to round off or chamfer certain corners of the box and lid to give the container a distinctive appearance. This has typically been achieved in the past by providing creasing lines or scoring lines in the blank at the areas forming the edges of the container. These lines allow the blank to be folded in such a way that the corner does not sharply bend but instead progressively bends between two adjacent walls.

For forming a container having bevelled or rounded edge portions and a certain maximum height, width and depth, the blank used for forming a square-edge container with the same maximum height, width and depth needs to be modified. In particular, the width of blank panels that form planar container walls connected by a bevelled or rounded edge portion needs to be reduced with respect to the width of the blank panels forming corresponding adjacent planar walls in the square-edge container. This is not only because of shape constraints, but also because, when the blank is folded to form a container certain pairs of blank panels are at least partly superimposed and affixed to each other to form walls of the container. This is the case of the blank side panels which are to form the side walls of the container. Thus, it is desirable that the inner blank panels do not interfere with a bevelled or rounded edge portion. Otherwise, this interference may hinder the automated folding operation and ultimately alter the shape of the bevelled or rounded edges of the container, thus potentially affecting the finish and general look of the container.

As a result, the overall width of a blank for forming a container having bevelled or rounded edge portions and a certain maximum height, width and depth is generally reduced with respect to the width of a blank for forming a square-edge container with the same maximum height, width and depth. Thus, a packing machine needs to undergo significant modifications in order to be able to receive and fold one such modified blank to form a container. This causes an increase in machine downtime, which is clearly undesirable, and generally entails additional manufacturing costs. Further, every time that even small changes are made to the shape of the blank or container, new machine adjustments typically become necessary.

Typically, creasing lines are formed in the blank to define the bevelled or rounded edge portions in the container. However, for such containers, it is necessary to include an additional 'pre-bending' step in the assembly process, to ensure that all creasing lines will fold in their intended manner. This requires specialist equipment and adds one or more of complexity, cost and time to the manufacturing process.

It would therefore be desirable to provide a blank for manufacturing a container for consumer goods, having rounded or bevelled edge portions that overcomes the drawbacks described above. In particular, it would be desirable to provide a blank for manufacturing such a container that makes the design, production and assembly process easier and more flexible. From a manufacturing standpoint, it would be particularly desirable to provide one such blank that can be folded by a conventional packing machine without requiring major structural modifications.

According to the present invention, there is provided a laminar blank for forming a container for consumer articles, and a container obtained by folding said laminar blank. The laminar blank comprises a bottom wall panel for forming a bottom wall of the container and a top wall panel for forming a top wall of the container. Further, the laminar blank comprises a rear wall panel for forming at least part of a rear wall of the container and a front wall panel for forming at least a part of a front wall of the container. In addition, the laminar blank comprises two first side panels extending from the rear wall panel and two second side panels extending from the front wall panel, such that, when the container is assembled from the laminar blank, the first and the second side panels overlap to form at least part of left and right side walls of the container. At least one of the first side panels, at least one of the second side panels, or at least one of the first side panels and at least one of the second side panels is connected to a respective rear wall panel or front wall panel by a modified edge portion. Each modified edge portion comprises a first zone comprising a plurality of creasing lines extending substantially in the longitudinal direction of the modified edge portion; and a second zone that is substantially free of creasing lines, the second zone being disposed between a first free edge of the modified edge portion and the first zone of the modified edge portion. The laminar blank further comprises at least one pair of dust flaps extending from the first side panels or the second side panels or both, such that, when the container is assembled from the laminar blank, the flaps in a pair overlap the bottom wall panel to form the bottom wall or the top wall panel to form the top wall. Each dust flap in the at least one pair of dust flaps comprises a main flap portion depending along a fold line from a respective first or second side panel and a side flap portion extending laterally from the flap main portion beyond a peripheral edge of the respective first or second side panel.

In contrast to known blanks for forming containers with non-square corners, the present invention comprises a modified edge portion having a first zone comprising a plurality of creasing lines extending substantially in the longitudinal direction of the modified edge portion; and a second zone that is substantially free of creasing lines, the second zone being disposed between a first free edge of the modified edge portion and the first zone of the modified edge portion. This can provide several advantages. In particular, because the second zone is substantially free of creasing lines, this zone of the laminar blank is less likely to bend at any one specific point when its associated side panel is subjected to a folding force. Consequently, the second zone can help to transfer an applied folding force across the plurality of creasing lines of the first zone and thus allow all of said creasing lines to respond to the folding force, rather than only a select number of creasing lines, such as the creasing line or lines closest to the point at which the force is applied. The creasing lines of the modified edge portion can therefore be folded in the intended manner to give the modified edge portion its intended shape, simply by application of a single folding force. For example, for a container having a rounded edge portion, the second zone can enable all creasing lines in the first zone of the modified edge portion to bend in response to the applied force, and thus define a gradual curve about the modified edge portion of the container. As another example, for a container having a bevelled edge portion having only two creasing lines to define two intended turning points in the blank, the second zone can enable the blank to bend about both creasing lines in response to the applied force, and thus enable a well-defined bevelled profile to be formed about the modified edge portion of the container. A container of the present invention with rounded or bevelled edge portions can therefore be formed from a creased laminar blank, without requiring a pre-bending step to be first carried out. The container of the present invention can therefore be assembled on a conventional packing machine without the need for any major modification, such as the inclusion of a component for pre-bending the modified edge portion, and thus saving on one or more of complexity, cost and time in the manufacturing process.

Furthermore, each dust flap in a pair of dust flaps extending from the blank side panels comprises a main flap portion, which depends along a fold line from a respective side panel, and a side flap portion, which extends laterally from the flap main portion beyond a peripheral edge of the respective first or second side panel.

Thus, the overall width of the blank is increased by an amount corresponding to twice the width of one such side flap portion. This at least partly compensates the reduction in the width of the blank panels forming the front/rear and side walls of the container, compared with a blank for forming a squared-edge container of substantially the same maximum width and depth, that is dictated by the desired shape of the container.

Accordingly, a container of the present invention can conveniently be formed from one such blank by a conventional packing machine for assembling a squared-edge container. On the other hand, the corrected overall width of the blank makes it advantageously possible for the blank to be received in, and folded by, a conventional packing machine without the need to make any major modification. Further, if the overall size (in terms of maximum width and depth) of a container is not significantly altered, the Applicant has advantageously found that it is easy to adapt the blank according to invention to form containers having different shapes, such that no major modifications of the packing machine are required.

Accordingly, the provision of a laminar blank having the dust flap arrangement and the modified edge portion arrangement described above, can together advantageously allow for a range of rounded or bevelled edge portion containers to be formed on conventional existing packaging machinery, without requiring major modification of said machinery.

The term "modified edge portion" is used herein to refer to an edge portion of the container having a non-square shape as viewed in cross-section. This may for example refer to a "curved edge portion", that is an edge portion of the container having an arc-like shape as viewed in cross-section. By the term "arc-like" reference is made to any non-straight line, including circular arc, parabolic arc, hyperbolic arc, elliptical arc, etc. Further, this may for example refer to a "bevelled edge portion", that is an edge portion of the container that has, as viewed in cross-section, a substantially straight shape forming an angle between 0 and 90 degrees with the adjacent walls of the container.

The term "creasing line" is used herein to refer to a line along the laminar blank that has been mechanically deformed, for example by mechanical pressing or rolling, to form a line of weakness in the blank about which the blank can be folded. In particular, the line of weakness is formed without removing material.

The term "free edge" is used herein to refer to an edge of the laminar blank. The free edge is not a fold in the laminar blank. Thus the free edge does not link two adjacent parts of the laminar blank of the invention.

The term "extending substantially in the longitudinal direction of the modified edge portion" is used here in to mean that a creasing line extends from a first point of the modified edge portion to a second point of the modified edge portion that together lie on an imaginary straight line that forms an angle of less than 20 degrees with the longitudinal direction of the modified edge portion.

As used herein, the terms "front", "back", "upper", "lower", "top", "bottom" and "side", refer to the relative positions of portions of containers according to the invention and components thereof. When describing containers according to the present invention, these terms are used irrespective of the orientation of the container being described. In the case of a hinge-lid container, the back wall of the container is the wall comprising the hinge line about which the lid is pivotable.

The term "inner surface" is used throughout the specification to refer to the side of a portion of the blank that, once the container is assembled, faces towards the interior of the container, for example towards the consumer goods, when the container is in the closed position. Likewise, the term "outer surface" is used throughout the specification to refer to the side of a portion of the blank that, once the container is assembled, faces towards the exterior of the container.

The term "spring-back force" is a known term of art for referring to a particular property of a laminar blank. It is sometimes referred to as 'the crease recovery' and means the force (N) required to hold a scored sample that is folded at 90 degrees for a 15-second period. The measurement is made at the end of the 15-second period. The spring-back force of a portion of a laminar blank can be measured using a known PIRA Crease and Board Stiffness Tester (commercially available for example from Messmer and Buchel, UK). As is known in the art, to measure the spring-back force of a curved edge portion of a container, a sample of the portion to be tested should first be removed from the laminar blank. For round corner packs, for the purposes of the present invention the spring-back force of a pack is assessed using a sample measuring 38±1 millimeters by 38±0.5 millimeters, with the corner forming portion being positioned 21±0.5 millimeters from one side of the blank. The blank should be conditioned at 22 degrees Celsius and 60 percent relative humidity for at least 24 hours prior to testing.

The expression "distance between creasing lines in a pair of creasing lines" is used to describe the width of the portion of the modified edge portion that resides between two creasing lines in a single pair of creasing lines. Such distance is construed as being measured along the width of the modified edge portion and between the respective symmetry axes of the creasing lines. In practice, because the creasing lines extend along the length of the modified edge portion, the distance between adjacent creasing lines in a single pair is measured substantially perpendicular to the lines themselves.

The expression "distance between adjacent pairs of creasing lines" is used to describe the width of the portion of modified edge portion separating two adjacent pairs of creasing lines. Such distance is construed as being measured along the width of the modified edge portion. In practice, because the creasing lines extend along the length of the modified edge portion, the distance between adjacent pairs of creasing lines is measured substantially perpendicular to the main axis of the creasing lines.

The term "proximate to" is used throughout this specification to describe a pair of creasing lines immediately adjacent another element of the container, such as a planar wall thereof. In practice, in some embodiments, one of the creasing lines of a first pair adjacent a first planar wall of the container extends substantially at the border between the planar wall of the container and the modified edge portion connecting the planar wall to another planar wall of the container.

Preferably, the second zone of each modified edge extends from the first zone of the modified edge portion to the first free edge of the modified edge portion, in the longitudinal direction of the modified edge portion. This can improve the transfer of an applied folding force across the plurality of creasing lines in the first zone.

Preferably, the length (L1) of the first zone is at least about 80 percent of the length (L) of the respective modified edge portion, more preferably at least about 90 percent of the length (L) of the respective modified edge portion, even more preferably at least about 95 percent of the length (L) of the respective modified edge portion.

Preferably, the second zone has a length (L2) of 3 millimeters or less in the longitudinal direction of the modified edge portion, more preferably a length (L2) of 1 millimeter or less in the longitudinal direction of the modified edge portion. Alternatively or additionally, preferably, the second zone has a length (L2) of 0.1 millimeters or more in the longitudinal direction of the modified edge portion, more preferably a length (L2) of 0.5 millimeters or more in the longitudinal direction of the modified edge portion. Such relatively small lengths for the second zone can help to ensure that the majority of the modified edge portion is defined by the first zone and its associated creasing lines to thereby give the modified edge portion its intended shape or profile when the container is in an assembled condition.

Preferably, each modified edge portion further comprises a third zone disposed between a second free edge of the modified edge portion and the first zone of the modified edge portion. This can improve the transfer of an applied folding force across the plurality of creasing lines. In such embodiments, the third zone preferably extends from the first zone to the second free edge of the modified edge portion in the longitudinal direction of the modified edge portion. This can improve the transfer of an applied folding force across the plurality of creasing lines.

Where each modified edge portion comprises a third zone, preferably the third zone has a length (L3) of 3 millimeters or less in the longitudinal direction of the modified edge portion, more preferably a length (L3) of 1 millimeter or less in the longitudinal direction of the modified edge portion. Alternatively or additionally, preferably the third zone has a length (L3) of 0.1 millimeters or more in the longitudinal direction of the modified edge portion, more preferably a length (L3) of 0.5 millimeters or more in the longitudinal direction of the modified edge portion. Such relatively small lengths for the third zone can help to ensure that the majority of the modified edge portion is defined by the first zone and its associated creasing lines to thereby give the modified edge portion its intended shape or profile when the container is in an assembled condition.

Each modified edge portion has a length (L) in the longitudinal direction of the modified edge portion and a width (w) that extends transversely to the length (L) across the modified edge portion. Preferably, in each dust flap in the at least one pair of dust flaps the side flap portion extends beyond the peripheral edge of the respective first or second side panel by at least about 25 percent of the width (w) of the modified edge portion. More preferably, in each dust flap in the at least one pair of dust flaps the side flap portion extends beyond the peripheral edge of the respective first or second side panel by at least about 35 percent of the width (w) of the modified edge portion.

In addition, or as an alternative, in each dust flap of the at least one pair of dust flaps, the side flap portion preferably extends beyond the peripheral edge of the respective first or second side panel by less than about 75 percent of the width (w) of the modified edge portion. More preferably, in each dust flap of the at least one pair of dust flaps, the side flap portion preferably extends beyond the peripheral edge of the respective first or second side panel by less than about 65 percent of the width (w) of the modified edge portion. Most preferably, in each dust flap of the at least one pair of dust flaps, the side flap portion preferably extends beyond the peripheral edge of the respective first or second side panel by less than about 55 percent of the width (W) of the modified edge portion.

Preferably, the laminar blank is for forming a container having a maximum width (W) and a maximum depth (D), wherein the width (w) of a modified edge portion is at least about 0.025 times (W+2D), where W is the maximum width of the container and D is the maximum depth of the container. In addition, or as an alternative, the laminar blank is for forming a container having a maximum width and a maximum depth, wherein the width (w) of a modified edge portion is preferably less than about 0.07 times (W+2D), where W is the maximum width of the container and D is the maximum depth of the container. More preferably, the width (w) of a modified edge portion is less than about 0.06 times (W+2D).

In practice, the maximum width (W) and the maximum depth (D) of the container shall substantially correspond to the maximum distance between the side walls of the container, and the maximum distance between the front and rear walls of the container, respectively. In many embodiments having a substantially quadrangular or rectangular cross-section, the maximum width (W) and the maximum depth (D) of the container shall substantially correspond to the maximum dimensions of the top or bottom wall of the container.

Preferably, in each dust flap of the at least one pair of dust flaps, the side flap portion extends beyond the peripheral edge of the respective first or second side panel by a length (E) such that the effective overall maximum width of the laminar blank substantially equals (W+2D), where W is the maximum width of the container and D is the maximum depth of the container.

The skilled person shall appreciate that, when a blank is designed with a view to making a container with maximum dimensions W and D, the reference container is typically a conventional, fully squared parallelepiped container. This geometry corresponds to a blank with an effective overall width of W+2D. Thus, the cooperating guides in a conventional packing machine shall be set substantially at a distance corresponding to that effective overall width. In containers according to the present invention where the side flap portion extends beyond the peripheral edge of the respective first or second side panel by a length (E) as defined above, the side flaps are particularly adapted to compensate for the reduction in width of front/rear and side panels to accommodate for the rounded/bevelled connecting edge portions that becomes necessary to accommodate for the rounded/bevelled connecting edge portions. In practice, this approximates a condition wherein the sum given by W*+2D*+2A+2E, wherein:

(W*+2D*) is the width of the rear/front panel in the blank for forming a container with non-squared edges and which is less than the maximum width W;

2A is the overall width of the modified edge portions; and 2E is the overall width of the side flap portions;

substantially equals (W+2D).

Preferably, the first zone of each modified edge portion comprises at least three creasing lines extending in parallel in the longitudinal direction of the modified edge portion.

Preferably, each modified edge portion comprises a plurality of pairs of creasing lines, all the creasing lines extending in parallel in the longitudinal direction of the curved edge portion, wherein the distance (X) between two creasing lines in each pair as measured along the width (W) of the modified edge portion is less than the distance (Y) between two adjacent pairs of creasing lines as measured along the width (W) of the modified edge portion. Surprisingly, it has been found that such an arrangement of creasing lines, when forming a rounded edge of a container, is easier, and results in the formation of an outer surface of the container that is smoother upon visual and tactile inspection on the part of the consumer. Further, the rounded edge of the container effectively approximates the theoretical, reference rounded shape with a relatively small number of creasing lines. Thus, at the same time, the strength of the container at the rounded edges may be better preserved.

Accordingly, according to a further aspect of the invention, there is provided a laminar blank for forming a container for consumer articles, the laminar blank comprising: a bottom wall panel for forming a bottom wall of the container and a top wall panel for forming a top wall of the container; a rear wall panel for forming at least a part of a rear wall of the container and a front wall panel for forming at least a part of a front wall of the container; two first side panels extending from the rear wall panel and two second side panels extending from the front wall panel, such that, when the container is assembled from the laminar blank, the first and the second side panels overlap to form at least part of left and right side walls of the container; wherein at least one of the first side panels, at least one of the second side panels, or at least one of the first side panels and at least one of the second side panels is connected to a respective rear wall panel or the front wall panel by a modified edge portion; each modified edge portion comprising: a first zone comprising a plurality of creasing lines extending substantially in the longitudinal direction of the modified edge portion; and a second zone that is substantially free of creasing lines, the second zone being disposed between a first free edge of the modified edge portion and the first zone of the modified edge portion; the laminar blank further comprising at least one pair of dust flaps extending from the first side panels or the second side panels or both, such that, when the container is assembled from the laminar blank, the flaps in a pair overlap the bottom wall panel to form the bottom wall or the top wall panel to form the top wall; wherein each dust flap in the at least one pair of dust flaps comprises a main flap portion depending along a fold line from a respective first or second side panel and a side flap portion extending laterally from the flap main portion beyond a peripheral edge of the respective first or second side panel; and wherein the first zone of each modified edge portion comprises a plurality of pairs of creasing lines, all the creasing lines extending in parallel in the longitudinal direction of the curved edge portion, wherein the distance (X) between two creasing lines in each pair as measured along the width (W) of the modified edge portion is less than the distance (Y) between two adjacent pairs of creasing lines as measured along the width (W) of the modified edge portion.

Preferably, the distance (X) between two creasing lines in each pair is less than about 1 millimeter. More preferably, the distance (X) between two creasing lines in each pair is less than about 0.8 millimeters. In addition, the distance (X) between two creasing lines in each pair is preferably at least about 0.4 millimeters. More preferably, the distance (X) between two creasing lines in each pair is preferably at least about 0.6 millimeters.

Preferably, the distance (Y) between two adjacent pairs of creasing lines is less than about 1.2 millimeters. More preferably, the distance (Y) between two adjacent pairs of creasing lines is less than about 1 millimeter. In addition, or as an alternative, the distance (Y) between two adjacent pairs of creasing lines is at least about 0.6 millimeters. More preferably, the distance (Y) between two adjacent pairs of creasing lines is at least about 0.8 millimeters.

Without wishing to be bound by theory, it has been identified that a particular ratio of the distance (X) between two creasing lines in each pair, with respect to the distance (Y) between two adjacent pairs of creasing lines can provide particularly smooth looking round corner portions, with relatively few creasing lines. In particular, preferably the distance (X) between two creasing lines in each pair is between about 70 percent and about 85 percent of the distance (Y) between two adjacent pairs of creasing lines, more preferably between about 75 percent and about 80 percent of the distance (Y) between two adjacent pairs of creasing lines.

In some preferred embodiments, the modified edge portion comprises at least a first pair of creasing lines proximate to the first planar wall and a second pair of creasing lines proximate to the second planar wall.

In some alternative embodiments, the modified edge portion comprises a first single creasing line and a second single creasing line adjoining the first planar wall and the second planar wall, respectively. Further, the modified edge portion comprises at least a first pair of creasing lines and a second pair of creasing lines extending between the first and the second single creasing line. The distance (Z1) between the first pair of creasing lines and the first single creasing line or the distance (Z2) between the second pair of creasing lines and the second single creasing line or both is greater than the distance (X) between two creasing lines in each pair as measured along the width (W) of the modified edge portion. Preferably, the distance (Z1) between the first pair of creasing lines and the first single creasing line is substantially equal to the distance (Z2) between the second pair of creasing lines and the second single creasing line.

The distance (Z1) between the first pair of creasing lines and the first single creasing line is preferably at least about 0.6 millimeters, more preferably at least 0.8 millimeters. Preferably, the distance (Z1) between the first pair of creasing line and the first single creasing line is less than about 1.2 millimeters.

Preferably, each creasing line has a width (CW) of at least about 0.05 millimeters, more preferably of at least about 0.1 millimeters, even more preferably of at least about 0.2 millimeters. In addition, or as an alternative, each creasing line has a width (CW) of less than about 0.6 millimeters, preferably less than about 0.5 millimeters, preferably less than about 0. millimeters, preferably less than about 0.3 millimeters, even more preferably less than about 0.2 millimeters. In some preferred embodiments, each creasing line has a width (CW) of from about 0.05 millimeters to about 0.4 millimeters, more preferably of from about 0.1 to about 0.3 millimeters.

Preferably, the blank has a spring-back force of less than about 10 milliNewton meters between any two panels that are connected by a modified edge portion, more preferably less than about 9 milliNewton meters, even more preferably less than about 7 milliNewton meters Preferably, the blank has a spring-back force of at least about 3 milliNewton meters between any two panels that are connected by a modified edge portion, more preferably at least about 4 milliNewton meters.

Blanks according to the present invention find application for the manufacture of containers for consumer goods, in particular elongate consumer goods such as smoking articles. However, they can also be used for several other types of consumer goods, such as confectionary. In particular, a container may be formed from a blank according to the present invention, wherein the laminar blank forms at least a part of the container comprising a box portion having a box front wall, a box rear wall and box side walls extending between the box front wall and the box rear wall, and wherein the modified edge portions connect at least one of the box front wall and the box rear wall to the box side walls. As an alternative, a container may be formed from a blank according to the present invention, wherein the laminar blank forms at least a part of the container comprising a lid portion having a lid front wall, a lid rear wall and lid side walls extending between the lid front wall and the lid rear wall, and wherein the modified edge portions connect at least one of the lid front wall and the lid rear wall to the lid side walls.

Blanks according to the present invention may be formed from any suitable material or combination of materials, including, but not limited to, cardboard, paperboard, plastic, metal, or combinations thereof. Preferably, the blank is a laminar cardboard blank having a weight of between about 100 grams per square meter and about 350 grams per square meter. In preferred embodiments, the blank has a thickness of from about 200 to about 400 micrometers, more preferably from 250 micrometers to 350 micrometers.

A container formed from a blank according to the present invention may optionally comprise an outer wrapper, which is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

Further, the consumer articles may be provided within one such container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which consumer goods can be removed when a lid of the container is in a respective open position.

The blank is preferably for forming a rectangular parallelepiped container comprising two wider walls spaced apart by two narrower walls. A hinge lid container formable from a blank according to the container shall typically comprise two longitudinal rounded or bevelled edges on the front wall, and/or two longitudinal rounded or bevelled edges on the back wall. These may optionally be in combination with one or more rounded or bevelled transverse edges.

Where the container comprises bevelled edges, preferably the bevelled edges have a width of between about 1 mm and about 10 mm, preferably between about 2 and about 6 mm.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions, containers according to the invention may be designed to hold different total numbers of smoking articles, or different arrangements of smoking articles. For example, through an appropriate choice of the dimensions, containers according to the invention may be designed to hold a total of between ten and thirty smoking articles. The smoking articles may be arranged in different collations, depending on the total number of smoking articles. Containers formed from blanks according to the present invention may hold smoking articles of the same type or brand, or of different types or brands. In addition, both filter-less smoking articles and smoking articles with various filter tips may be contained, as well as smoking articles of differing length (for example, between about 40 mm and about 180 mm), diameter (for example, between about 4 mm and about 9 mm). Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container. The length, width and depth of containers according to the invention may be such that the resultant overall dimensions of the container are similar to the dimensions of a typical disposable pack of twenty cigarettes.

Thus, it shall be appreciated that the total number and the arrangement of the smoking articles within the container shall generally directly impact the maximum width and depth of the container and, correspondingly the geometric features of certain blanks according to the invention as described above. In particular, in certain preferred embodiments, the size of the side portions of the dust flaps can be selected such as to ensure that the container can accommodate a predetermined number of smoking articles in a given arrangement. Accordingly, the skilled person shall appreciate how the present invention provides a valuable and versatile tool for designing and manufacturing containers suitable to receive substantially any number of smoking articles in any given arrangement.

Preferably, containers according to the invention have a height of between about 60 mm and about 150 mm, more preferably a height of between about 70 mm and about 125 mm, wherein the height is measured from the bottom wall to the top wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container.

Preferably, the ratio of the height of the container to the depth of the container is in between about 0.3 to 1 and about 10 to 1, more preferably between about 2 to 1 and about 8 to 1, most preferably between about 3 to 1 and 5 to 1

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Preferably, the ratio of the height of the lid back wall to the height of the box back wall of the outer sleeve is between about 0 to 1 (lid located at the top edge of the container) to about 1 to 1, more preferably, between about 1 to 5 and about 1 to 10, most preferably, between about 1 to 6 to about 1 to 8.

Preferably, the ratio of the height of the lid front wall of the outer sleeve to the height of the box front wall of the outer sleeve is between about 1 to 0 (lid covering the entire front wall) to about 1 to 10, more preferably, between about 1 to 1 and about 1 to 5, most preferably, between about 1 to 2 and about 1 to 3.

The surfaces of blanks according to the invention which correspond to exterior surfaces of containers may be printed, embossed, debossed or otherwise embellished with manufacturer or brand logos, trade marks, slogans and other consumer information and indicia.

Containers according to the present invention may hold smoking articles of the same type or brand, or of different types or brands. In addition, both filter-less smoking articles and smoking articles with various filter tips may be contained, as well as smoking articles of differing length (for example, between about 40 mm and about 180 mm), diameter (for example, between about 4 mm and about 9 mm). Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container.

The length, width and depth of containers according to the invention may be such that the resultant overall dimensions of the container are similar to the dimensions of a typical disposable pack of twenty cigarettes.

Preferably, containers according to the invention have a height of between about 60 mm and about 150 mm, more preferably a height of between about 70 mm and about 125 mm, wherein the height is measured from the bottom wall to the top wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container.

Preferably, the ratio of the height of the container to the depth of the container is in between about 0.3 to 1 and about 10 to 1, more preferably between about 2 to 1 and about 8 to 1, most preferably between about 3 to 1 and 5 to 1

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Preferably, the ratio of the height of the lid back wall to the height of the box back wall of the outer sleeve is between about 0 to 1 (lid located at the top edge of the container) to about 1 to 1, more preferably, between about 1 to 5 and about 1 to 10, most preferably, between about 1 to 6 to about 1 to 8.

Preferably, the ratio of the height of the lid front wall of the outer sleeve to the height of the box front wall of the outer sleeve is between about 1 to 0 (lid covering the entire front wall) to about 1 to 10, more preferably, between about 1 to 1 and about 1 to 5, most preferably, between about 1 to 2 and about 1 to 3.

The exterior surfaces of containers according to the invention may be printed, embossed, debossed or otherwise embellished with manufacturer or brand logos, trade marks, slogans and other consumer information and indicia.

The invention will be further described, by way of example only, with reference to the accompanying drawings in which:

FIG. 4B shows an enlarged view of a portion of the blank of FIG. 3 and FIG. 4A; and FIG. 5 shows a schematic cross-sectional view of the first zone of each modified edge portion of the blank of FIGS. 3, 4A and 4B.

Figure 1:
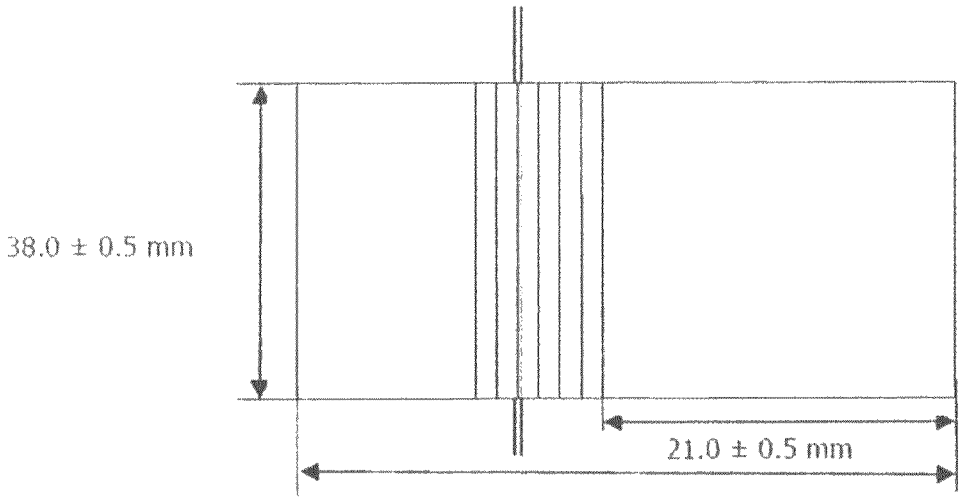
FIG. 1 depicts a sample portion of a laminar blank for use in determining the spring-back force of the blank.
Figure 2:
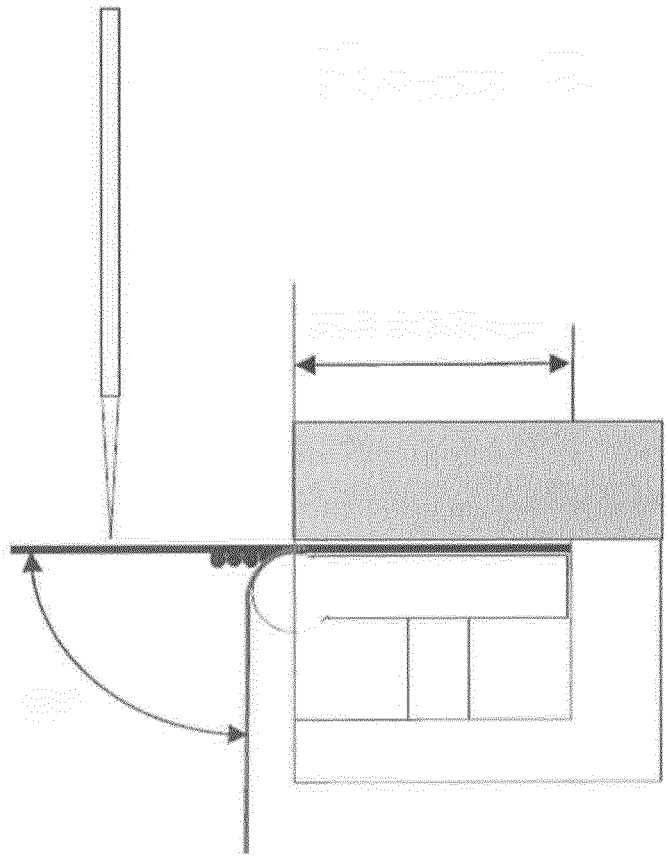
FIG. 2 depicts an apparatus for determining the spring-back force of a blank.
Figure 3:
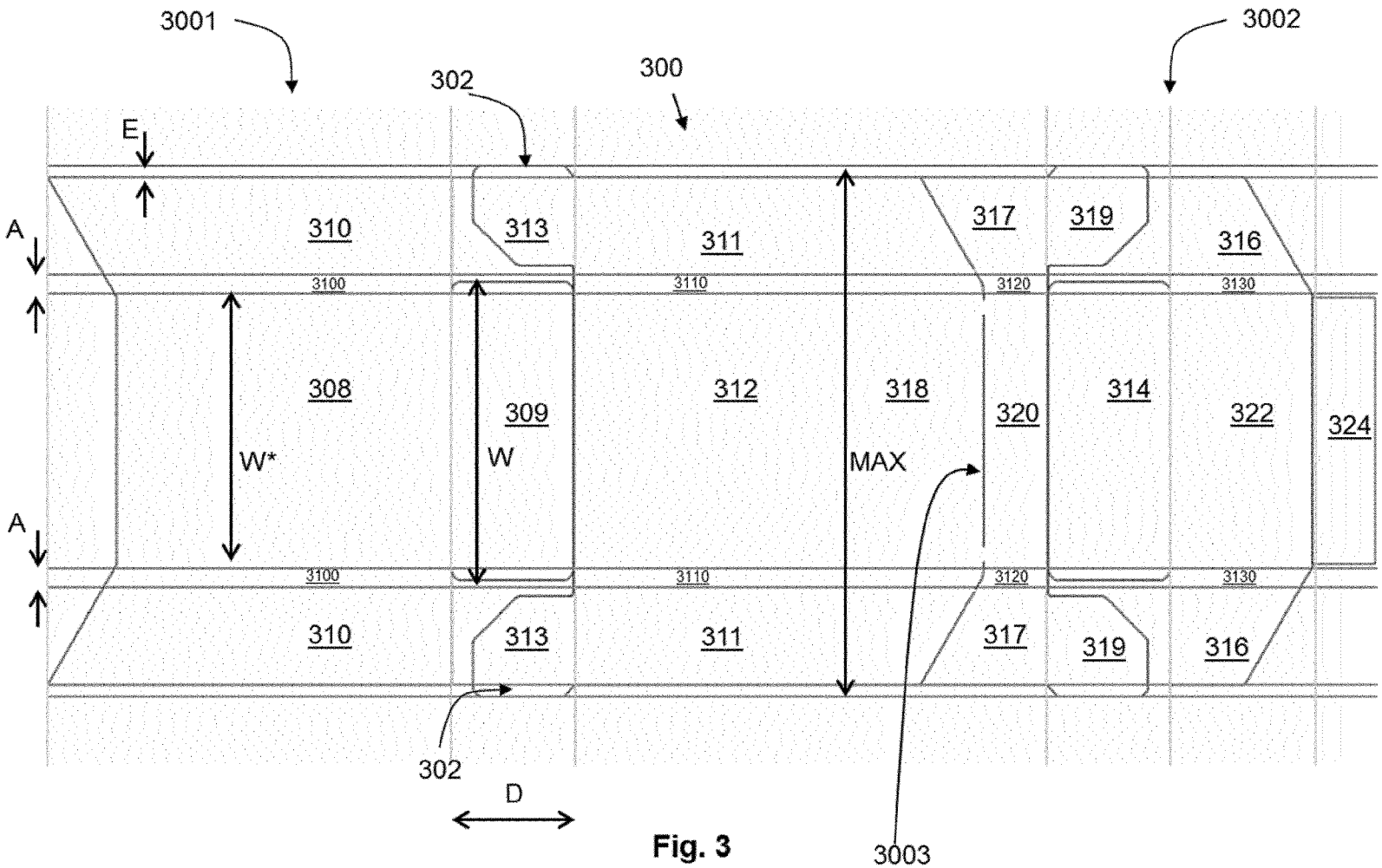
FIG. 3 shows a schematic top view of an embodiment of a blank in accordance with the present invention.
Figure 4A:
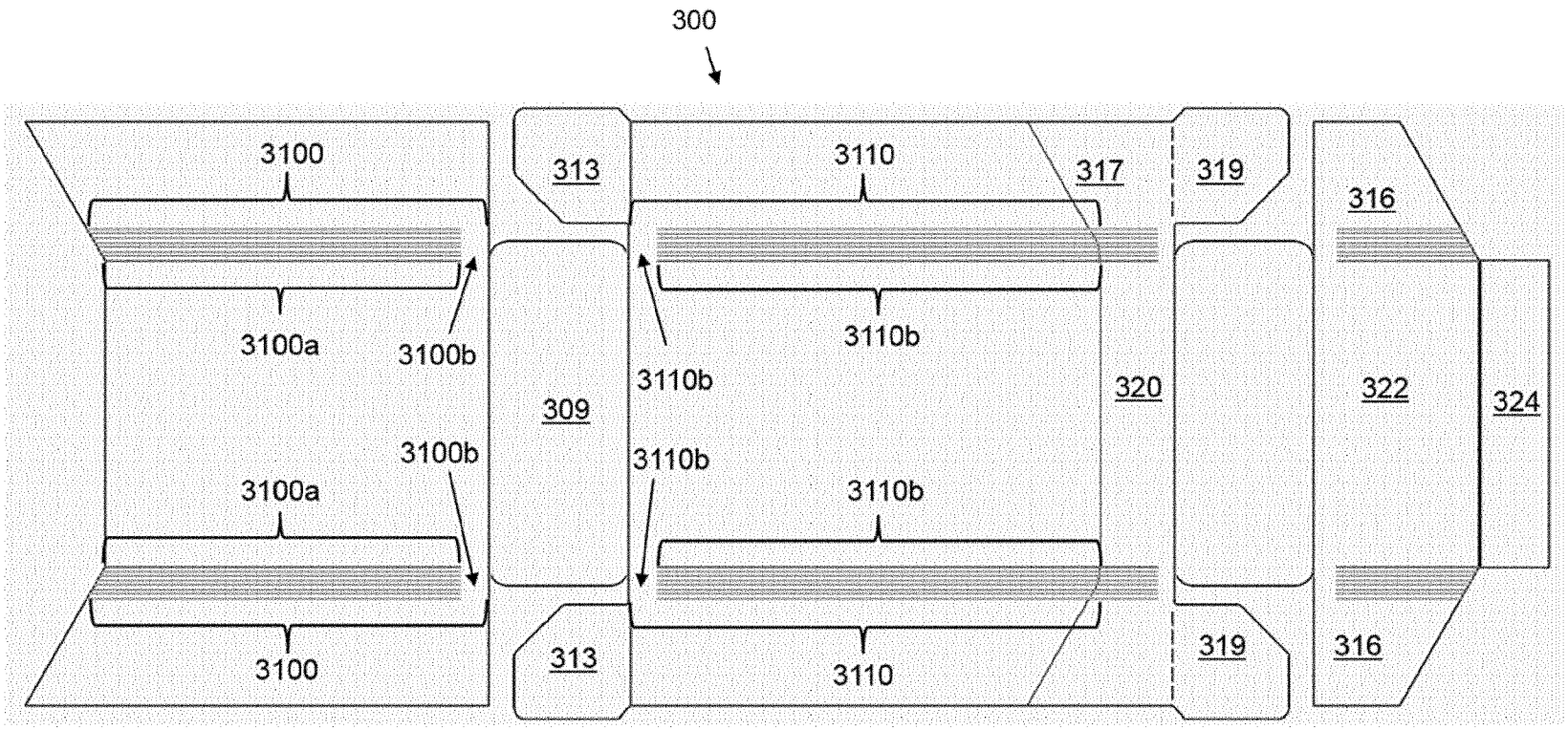
FIG. 4A shows a schematic top view of the blank of FIG. 3, illustrating modified edge portions in greater detail.

FIG. 3 is a view of a cardboard laminar blank 300 for forming a container for consumer goods according to the invention. FIG. 4A also shows the cardboard laminar blank 300 of FIG. 3, with the creasing lines of modified edge portions 3100, 3110, 3120 and 3130 being clearly visible. FIG. 4B shows an enlarged view of FIG. 4A.

The blank 300 comprises a box blank portion 3001 for forming a box portion of the container, and a lid blank portion 3002 for forming a lid portion of the container. The box blank portion 3001 depends from the lid blank portion 3002 along hinge line 3003.

The box blank portion 3001 comprises a front wall panel 308, a rear wall panel 312 and a bottom wall panel 309. Two side wall panels 310 extend from front wall panel 308, two side wall panels 311 extend from rear wall panel 312, and two box dust flaps 313 extend from side wall panels 311. When the box portion of the container is assembled from the box blank portion 3001, the front wall panel 308 forms the container front wall, the rear wall panel 312 forms the container rear wall, the side wall panels 310, 311 overlap to form left and right side container walls, and the box dust flaps 313 overlap the bottom wall panel 309 to form the container bottom wall. The side wall panels 310, 311 are substantially the same size and shape as each other. When the container is formed, the side wall panels 310, 311 directly overlie each other with their free edges substantially aligned, such that the inner side wall panel is barely visible. The box dust flaps 313 are smaller than the bottom wall panel 309. When the container is formed, the box dust flaps 313 lie inside the bottom wall panel 309. They provide additional structural support for the container bottom wall of the container but are not visible from the outside of the container.

The lid blank portion 3002 comprises a front wall panel 322, a rear wall panel 320 and a top wall panel 314. Two side wall panels 316 extend from the front wall panel 322, two side wall panels 317 extend from the rear wall panel 320, and lid dust flaps 319 extend from the side wall panels 317. When the lid portion of the container is assembled from the lid blank portion 3002, the front wall panel 322 forms the container front wall, the rear wall panel 320 forms the container rear wall, the side wall panels 316, 317 overlap to form right and left container side walls, and the lid dust flaps 319 overlap top wall panel 314 to form the lid top wall. The side wall panels 316, 317 are substantially the same size and shape as each other. When the container is formed, the panels 316, 317 directly overlie each other with their free edges substantially aligned, such that the inner side wall panel is barely visible from the exterior of the container. The lid dust flaps 319 are smaller than the top wall panel 314. When the container is formed, the lid dust flaps 319 lie inside the top wall panel 314. They provide additional structural support for the container (lid) top wall, but are not visible from the outside of the container.

As shown in FIG. 3, FIG. 4A and FIG. 4B, each dust flap 313 and 319 comprises a main flap portion, which depends along a fold line from a respective side panel 311, 317, and a side flap portion extending laterally from the flap main portion beyond a peripheral edge of the respective side panel 311, 317. In more detail, in each dust flap 313, 319 of either pair of dust flaps, the side flap portion extends beyond the peripheral edge of the respective side panel 311, 317 by a length (arrows E) such that the overall maximum width of the blank (arrow MAX) substantially equals (W+2D), where W is the maximum width of the container (arrow W) and D is the maximum depth of the container (arrow D).

The side panels 310, 311, 317 and 316 are connected by modified edge portions 3100, 3110, 3120 and 3130 to front wall panel 308, the rear wall panel 312, front rear wall panel 320, and front wall panel 322, respectively. Each of the modified edge portions 3100, 3110, 3120 and 3130 has an inner and an outer surface. The modified edge portions 3100, 3110, 3120 and 3130 each comprise a respective first zone 3100*a*, 3110*a*, 3120*a* and 3130*a* that each comprise eight creasing lines extending in parallel in the longitudinal direction of their respective modified edge portion 3100, 3110, 3120 and 3130.

The modified edge portions 3100, 3110, 3120 and 3130 each also comprise a respective second zone 3100*b*, 3110*b*, 3120*b* and 3130*b* that is substantially free of creasing lines. The second zones 3100*b*, 3110*b*, 3120*b* and 3130*b* are each disposed between their respective first zone 3100*a*, 3110*a*, 3120*a* and 3130*a*, and a first free edge of their respective modified edge portion 3100, 3110, 3120 and 3130.

Each creasing line has a width of about 0.1 millimeters. For clarity, the creasing lines are not shown in FIG. 3, but are clearly visible in FIGS. 4A and 4B. A magnified view of the lid blank portion 3002 is shown in FIG. 4B to better illustrate the details of modified edge portions 3120 and 3130.

FIG. 5 shows a schematic cross-sectional view of the first zone of each modified edge portion of the blank of FIGS. 3, 4A and 4B.

As illustrated in FIG. 5, the first zone A comprises a first pair 40 of creasing lines proximate to a first panel 20, such as the box front wall panel 308 and a second pair 42 of creasing lines proximate to a second panel 24, such as a box side wall panel 310. The distance X between two creasing lines in each of the pairs 40, 42 as measured along the width W of the modified edge portion is about 0.8 millimeters. Further, the first zone comprises another pair 44 of creasing lines. The distance Y between two adjacent pairs of creasing lines, such as for example the distance between pair the 40 and the pair 44, as measured along the width W of the modified edge portion, is about 1 millimeter.

When the blank 300 is fed into a conventional packing machine for forming a parallelepiped hinged lid container having maximum width W and maximum depth D, the packing machine easily folds the blank to form a container with rounded edges that has the same maximum width and depth.

In an alternative embodiment (not illustrated) each modified edge portion may consist of only a first and a second creasing lines extending in parallel in the longitudinal direction of the edge portion. When the alternative embodiment is fed into a conventional packing machine for forming a parallelepiped hinged lid container having maximum width W and maximum depth D, the packing machine easily folds the blank to form a container with bevelled edges that has the same maximum width and depth.

The invention claimed is:

1. A laminar blank for forming a container for consumer articles, the laminar blank comprising:

a bottom wall panel for forming a bottom wall of the container and a top wall panel for forming a top wall of the container;

a rear wall panel for forming at least a part of a rear wall of the container and a front wall panel for forming at least a part of a front wall of the container;

two first side panels extending from the rear wall panel and two second side panels extending from the front wall panel, such that, when the container is assembled from the laminar blank, the first and the second side panels overlap to form at least part of left and right side walls of the container;

wherein at least one of the first side panels, at least one of the second side panels, or at least one of the first side panels and at least one of the second side panels is connected to a respective rear wall panel or the front wall panel by a modified edge portion;

each modified edge portion comprising:

a first zone comprising a plurality of creasing lines extending substantially in the longitudinal direction of the modified edge portion; and a second zone that is substantially free of creasing lines, the second zone being disposed between a first free edge of the modified edge portion and the first zone of the modified edge portion;

the laminar blank further comprising at least one pair of dust flaps extending from the first side panels or the second side panels or both, such that, when the container is assembled from the laminar blank, the flaps in a pair overlap the bottom wall panel to form the bottom wall or the top wall panel to form the top wall;

wherein each dust flap in the at least one pair of dust flaps comprises a main flap portion depending along a fold line from a respective first or second side panel and a side flap portion extending laterally from the flap main portion beyond a peripheral edge of the respective first or second side panel; and wherein the first zone of each modified edge portion comprises a plurality of pairs of creasing lines, all the creasing lines extending in parallel in the longitudinal direction of the modified edge portion, wherein the distance (X) between two creasing lines in each pair as measured along the width (W) of the modified edge portion is less than the distance (Y) between two adjacent pairs of creasing lines as measured along the width (W) of the modified edge portion.

2. A laminar blank according to claim 1, wherein the second zone extends from the first zone to the first free edge of the modified edge portion in the longitudinal direction of the modified edge portion.

3. A laminar blank according to claim 1, wherein the second zone has a length (L2) of 5 millimeters or less in the longitudinal direction of the modified edge portion.

4. A laminar blank according to claim 1, wherein each modified edge portion further comprises a third zone disposed between a second free edge of the modified edge portion and the first zone of the modified edge portion.

5. A laminar blank according to claim 1, wherein each modified edge portion has a length (L) in its longitudinal direction and a width (A) that extends transversely to the length (L) across the modified edge portion; and wherein, in each dust flap of the at least one pair of dust flaps the side flap portion extends beyond the peripheral edge of the respective first or second side panel by at least about 25 percent of the width (A) of the modified edge portion.

6. A laminar blank according to claim 5, wherein, in each dust flap of the at least one pair of dust flaps, the side flap portion extends beyond the peripheral edge of the respective first or second side panel by less than about 75 percent of the width (A) of the modified edge portion.

7. A laminar blank according to claim 1, wherein the laminar blank is for forming a container having a maximum width and a maximum depth; and wherein the width (A) of the modified edge portion is at least about 0.025 times (W+2D), where W is the maximum width of the container and D is the maximum depth of the container.

8. A laminar blank according to claim 1, wherein the laminar blank is for forming a container having a maximum width and a maximum depth; and wherein the width (A) of the modified edge portion is less than about 0.07 times (W+2D), where W is the maximum width of the container and D is the maximum depth of the container.

9. A laminar blank according to claim 1, wherein the laminar blank is for forming a container having a maximum width and a maximum depth; and wherein, in each dust flap of the at least one pair of dust flaps, the side flap portion extends beyond the peripheral edge of the respective first or second side panel by a length (E) such that the overall maximum width of the laminar blank substantially equals (W+2D), where W is the maximum width of the container and D is the maximum depth of the container.

10. A laminar blank according to claim 1, wherein the first zone of each modified edge portion comprises at least three creasing lines extending in parallel in the longitudinal direction of the modified edge portion.

11. A laminar blank according to claim 1, wherein each creasing line has a width (WA) of from about 0.1 millimeters to about 0.4 millimeters.

12. A laminar blank according to claim 1, wherein the blank has a spring-back force of less than about 10 milliNewton meters between any two panels that are connected by a modified edge portion.

13. A container obtained by folding a laminar blank according to claim 1, wherein the laminar blank forms at least a part of the container comprising a box portion having a box front wall, a box rear wall and box side walls extending between the box front wall and the box rear wall, and wherein the modified edge portions connect at least one of the box front wall and the box rear wall to the box side walls.

14. A container obtained by folding a laminar blank according to claim 1, wherein the laminar blank forms at least a part of the container comprising a lid portion having a lid front wall, a lid rear wall and lid side walls extending between the lid front wall and the lid rear wall, and wherein the modified edge portions connect at least one of the lid front wall and the lid rear wall to the lid side walls.

* * * * *